United States Patent [19]

Cherny et al.

[11] 4,083,023

[45] Apr. 4, 1978

[54] CONTACT SPRING PILE-UP ASSEMBLY

[76] Inventors: Iosif Semenovich Cherny, ulitsa Zernovaya 6/1, kv. 85; Mikhail Vasilievich Mischenko, ulitsa Kirgizskaya 5a, kv. 3, both of Kharkov, U.S.S.R.

[21] Appl. No.: 673,477

[22] Filed: Apr. 5, 1976

[30] Foreign Application Priority Data

Apr. 7, 1975 U.S.S.R. ..... 2122529

[51] Int. Cl.[2] ..... H01H 63/10

[52] U.S. Cl. ..... 335/135; 200/283

[58] Field of Search ..... 335/135; 200/243, 244, 200/247, 283

[56] References Cited

U.S. PATENT DOCUMENTS

| | | | |
|---|---|---|---|
| 3,126,466 | 3/1964 | Schwartz | 200/283 X |
| 3,387,239 | 6/1968 | Chenall | 335/135 |

FOREIGN PATENT DOCUMENTS

| | | | |
|---|---|---|---|
| 643,349 | 3/1928 | France | 335/135 |

*Primary Examiner*—George Harris

*Attorney, Agent, or Firm*—Lackenbach, Lilling & Siegel

[57] ABSTRACT

The proposed pile-up assembly comprises metallic fastenings with contact springs being placed therebetween. These springs are insulated from one another by plates made of a thermoplastic material. The assembly also comprises a bush extending through openings made in the fastenings and the plates and connecting all the assembly components. Each plate is provided, according to the invention, with projections running the length of the surface facing the contact springs. The height of the projections is chosen so that when the invention is clamped during assembly, the contact springs are depressed against said projection until they come in contact with the surface of the plates. Employment of the proposed invention permits a reduction of labor consumption during assembly.

3 Claims, 3 Drawing Figures

CONTACT SPRING PILE-UP ASSEMBLY

This invention relates to electromagnetic relays and, in particular, to constructions of contact spring pile-up assemblies of electromagnetic relays. The invention can be employed in electromagnetic relays having several groups of contacts for switching.

There are various contact spring pile-up assemblies of electromagnetic relays known, where each row of contact springs is filled up with a hot liquid insulation material in press moulds in advance (cf. FRG Pat. No. 1,141,138).

Such technical approach is unacceptable in designing electromagnetic relays featuring piles where contact members are rigid snubber springs and flexible contact springs, since the liquid compound may flow in between the flexible springs, thus forming a plastic flash which has to be removed. In this case clearing the flash takes more time than does assembly of the whole device.

There are several patents where slotted plates are used as an insulation material, springs being fastened in these slots by various methods (cf. Fr. Pat. No. 1,054,307 an FRG Pat. No. 1,285,063). In this group the most uncomplicated and ingenious is a device provided with steering projections for snubber springs fitting into slots of the plastic frame. Such a construction can only be used in relays with plastic casings (cf. U.S. Pat. No. 3,142,735). The squeezing effort to prevent springs from turning in the slots is produced by a screw. The main drawback of such a design is that forced squeezing of the assembly by the screw is constantly accompanied by formation of fine shavings, when the screw is driven into th frame.

There are contact spring pile-up assemblies of electromagnetic relays known (cf. U.S. Pat. No. 3,142,735), wherein contact springs are secured by means of projections disposed around the periphery of the insulating plates. In such a construction there are additionally provided lugs fitting into the contact members. Such design permits elimination of longitudinal movements of the contact springs. The disadvantage is that its assembly cannot be automated because of the necessity of accurately aligning the insulating plates members with the contact springs.

As a prototype a pile-up assembly of an electromagnetic relay was taken, comprising metallic fastenings, contact springs plated therebetween and insulated from one another by plates made of thermoplastic material, and a bush extending through openings made in the fastenings and the plates and connecting all the components of the assembly.

Each contact spring is provided with two holes and each insulating plate is provided with two lugs fitting into the holes of the contact springs for assembly. During assembly of the device and before its parts are clamped, the contact springs and plates are covered by a liquid thermoreactive material by means of a special applicator. After bonding and clamping the ends of the bush are riveted over, the assembly is placed into an oven and heat treated.

The basic disadvantages of this prototype consist in that:

contact springs are to be made with two slots and, consequently, the axes of these slots are to be matched when a contact spring is attached to a plate;

the holes in the contact springs and the lugs of the insulating plates cannot be closely jointed and, consequently, adhesive and heat treatment are to be used for the pile assembly.

As a result assembly of this pile is a fairly labor consuming task.

It is an object of this invention to provide such a relay contact spring pile-up assembly which is less labor consuming to assemble.

These and other objects are achieved by a contact spring pile-up assembly comprising metallic fastenings, contact springs placed therebetween and insulated from one another by plates made of a thermoplastic material, an a bush extending through holes made in the fastenings and plates and connecting all parts of the assembly. According to the invention, each plate of thermoplastic material is provided with a projections running the length of the surface facing the contact springs, and the height of the of springs is chosen so that when the pile is clamped during assembly, the contact springs are depressed against said projections until they come in contact with the surface of the plates.

The essence of the invention consists in that thermoplastic plates are provided with projections running the length of the surface facing the contact springs, the height of said projections being chosen so as to ensure depression of the contact springs against said projections, when the pile is clamped for assembly, until they contact the surface of the plate. Reliable connection of all parts of the assembly is achieved by each contact spring forming an individual "lock" on the surface of the projections, thus preventing relative movement of its components.

It is advisable that the height of the projections be less than half the thickness of a contact spring. Such a height ensures formation of a "lock" on the surfaces of the projections of two adjacent plates, between which the contact spring is placed, that is formation of a two sided "lock" is ensured and reliability of assembly of all components of the pile is increased.

If the height of the projections is made more than half the thickness of a contact springs, the projections tend to close during assembly and the spring being depressed against said projections does not come into contact with the plate and remains suspended, thus making the "lock" unreliable.

The invention will now be described in greater detail with reference to a specific embodiment thereof taken in conjunction with the accompanying drawings, wherein.

Figure 1:
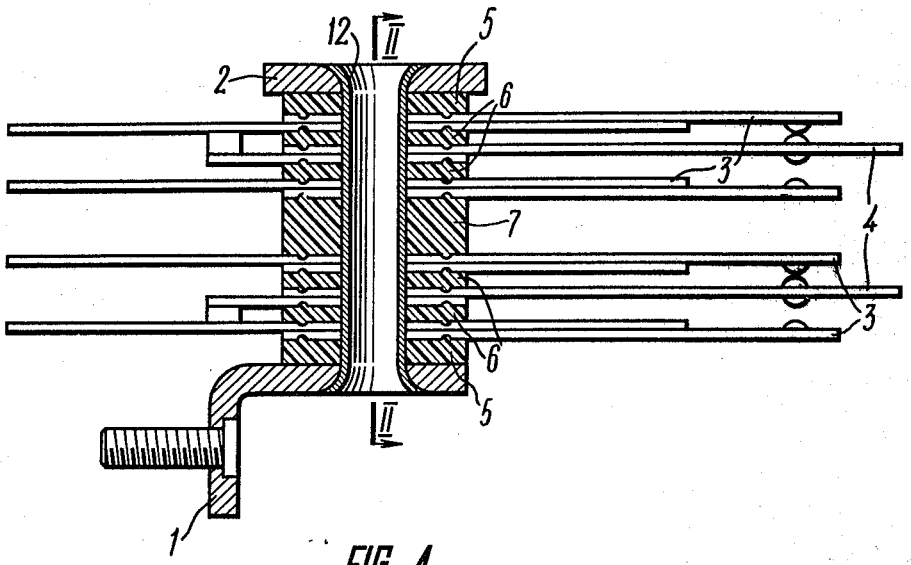
FIG. 1 is an elevational view, partially in section, of a pile of springs, according to the invention.
Figure 2:
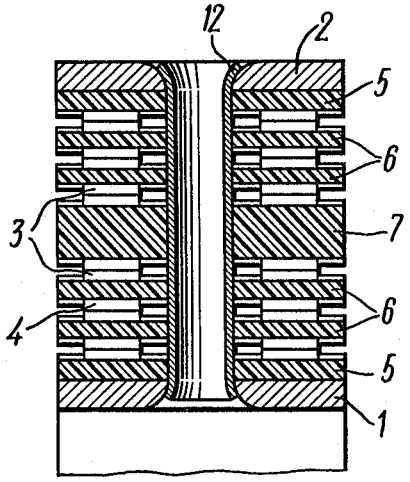
FIG. 2 is a class sectional view taken along the line II—II of FIG. 1.

A relay, contact pile-up assembly comprises metallic fastenings 1 (FIGS. 1 and 2) and 2 contact springs 3 and 4 positioned therebetween.

The contact springs 3 and 4 are insulated from one another by plates 5, 6 and 7 made of a thermoplastic material.

The fastenings 1, 2 and the plates 5, 6, 7 are provided with holes 8 (FIG. 3), 9, 10 and 11 made in the center of said fastenings and plates. The assembly also comprises a bush 12 extending through said holes and connecting all the components of the assembly.

The fastening 1 is a metallic angle with a central hole 8. The diameter of the hole 8 is larger than the outer diameter of the bush 12. The inner side of the hole 8 is bevelled to support the beaded end of the bush 12.

The fastening 2 is a flat metallic plate with a central hole 9. The size and shape of the hole 9 are identical to the size and shape of the hole 8 of the angle fastening 1.

The contact springs 3 and 4 are composed of flexible contact springs 13 and rigid snubber springs 14 welded prior to assembly. The springs 4 are longer than the springs 3. The longer arms of the springs 4 are intended for interaction with the contact switching mechanism of an electromagnetic relay (not shown).

The plates 5, 6 and 7 made of thermoplastic material are rectangular and are provided with central holes 10 and 11. The diameter of these holes is equal to the diameter of the holes 8 and 9. The thickness of the plates may vary depending upon peculiarities of the design of each pile.

The bush 12 is a thin-walled metallic tube, one end being beaded in advance.

According to the invention, each plate 5, 6 and 7 is provided with projections 15 (FIG. 3) running the length of the surface facing the contact springs 3 and 4. The plates 5 are provided with the projections 15 on one side. The other side of the plates 5 contacting the fastenings 1 and 2 in an assembled pile is smooth. The plates 6 and 7 have projections 15 on both sides. At least two projections are to be provided on each side of each plate 5, 6 and 7. It is not advisable to provide three or more projections on each side of a plate, because their number is proportional to the depression effort of the contact springs, whereas the reliability of a "lock" remains the same.

The height of the projections 15 is chosen so that, when the pile is clamped for assembly, the contact springs 3 and 4 are depressed against the projections until they come in contact with the surface of the plates 5, 6, 7. The height of the projections 15 is preferably less than half the thickness of the contact springs 3 and 4. Suc a height ensures formation of a "lock" on the surfaces of the projections of two adjacent plates between which the contact spring is positioned.

Figure 3:
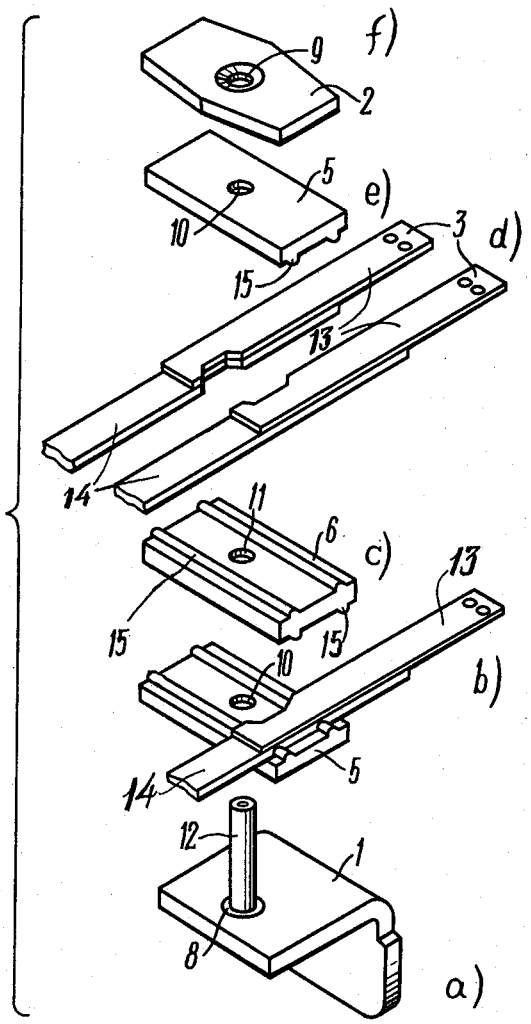
FIG. 3 is an exploded view of some of the components of the device (*a, b, c, d, e, f*) positioned as they are placed in the assembly.

The device is assembled as follows (see FIG. 3). The fastening 1 and the bush 12 are placed together in an assembly attachment (not shown), as is shown in FIG. 3 (*a*). The insulating plate 5 is arranged on top of the fastening 1 with the projections 15 facing away from the fastening 1, the hole 10 being aligned with the bush (FIG. 3 (*b*)). Two contact springs 3 are then placed on the plate 5 perpendicularly to the projections 15 (FIG. 3 (*b*)). The insulating plate 6 is placed on top of the already placed springs 3, the projections 15 on the lower side of the plate 6 being in contact with the already placed springs 3. Two springs 4 are placed on top of the plates 6, a second plate 6 is placed on top of the springs 4, another pair of springs 3 is placed on the second plate 6, and the plate 7 is placed on top of the second set of springs 3. The top half of the device is symmetrical with the lower half and is assembled accordingly.

The assembly is then clamped by means of the forementioned device acting on the fastening 2. All contact springs 3 and 4 are depressed against the projections 15 of each adjacent plate 5, 6 and 7 until they come in contact with the surfaces of respective plates thus forming a reliable "lock" for each contact spring and preventing them from turning with respect to the plates 5, 6, 7. The assembly being so compressed, the end of the bush 12 at the fastening 2 is riveted over and the completely assembled pile is removed from the assembly device.

The design of this assembly ensures reliable placement of all components with relation to one another. The efficiency of the assembly process derives because, firstly, the components need not be accurately aligned, secondly, there is no need to use adhesive and heat treatment and, thirdly, the process of installation of some components can be mechanized and the process of the pile compression can be automated.

What is claimed is:

1. A relay contact pile-up assembly comprising: metallic fastenings with holes; contact springs placed between said fastenings; plates of thermoplastic material provided with holes and having projections running the length of the surface facing said contact springs, said plates insulating said contact springs from one another; a bush extending through said holes in said fastenings and said plates and connecting all said parts of the assembly; the height of said projections being chosen so that when the assembly is compressed in the process of assembly, said contact springs are depressed against said projections until they come in contact with the surface of said plate.

2. A relay contact pile-up assembly as claimed in claim 1, wherein the height of said projections is less than half the thickness of said contact springs.

3. A relay contact pile-up assembly including metallic fastenings with holes, contact springs placed between said fastenings, insulating plates with holes placed between said springs and insulating said springs from one another, and a bush extending through said holes in said fastenings and said plates and connecting all of said parts of said assembly, said assembly further comprising: projections on the surfaces of the plates facing the contact springs, said projections extending the length of said surface, the height of said projections being selected such that when said assembly is depressed during assembly, said contact springs are depressed against said projections until said springs come in contact with said plate.

* * * * *